US009064405B2

(12) United States Patent
Lee

(10) Patent No.: US 9,064,405 B2
(45) Date of Patent: Jun. 23, 2015

(54) ELECTRONIC APPARATUS AND METHOD FOR DETECTING INFORMATION USING THE SAME

(71) Applicant: SAMSUNG ELECTRONICS CO., LTD., Suwon-si (KR)

(72) Inventor: Chang-rok Lee, Seoul (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 191 days.

(21) Appl. No.: 13/734,050

(22) Filed: Jan. 4, 2013

(65) Prior Publication Data

US 2013/0176117 A1 Jul. 11, 2013

(30) Foreign Application Priority Data

Jan. 5, 2012 (KR) ..... 10-2012-0001723

(51) Int. Cl.
*G08C 19/28* (2006.01)
*G08C 19/26* (2006.01)
*G08C 17/02* (2006.01)

(52) U.S. Cl.
CPC ..... *G08C 19/26* (2013.01); *G08C 17/02* (2013.01)

(58) Field of Classification Search
CPC ..... G08C 19/28; H04Q 19/14
USPC ..... 340/12.17, 3, 1, 5.61, 12.22; 341/176
See application file for complete search history.

(56) References Cited

U.S. PATENT DOCUMENTS

| | | | | |
|---|---|---|---|---|
| 5,172,346 | A * | 12/1992 | Wagner et al. | 367/197 |
| 6,147,719 | A * | 11/2000 | Shafer | 348/734 |
| 2008/0155636 | A1 * | 6/2008 | Cruz et al. | 725/131 |

FOREIGN PATENT DOCUMENTS

| | | | |
|---|---|---|---|
| DE | 3508562 | A1 | 9/1986 |
| EP | 0 421 471 | A1 | 4/1991 |
| EP | 1 168 272 | A2 | 1/2002 |

* cited by examiner

*Primary Examiner* — Vernal Brown
(74) *Attorney, Agent, or Firm* — Sughrue Mion, PLLC

(57) ABSTRACT

An electronic apparatus is provided. The electronic apparatus performs two-way communication with a remote control device, and includes a receiving unit which receives a data signal from the remote control device, a signal processing unit which performs signal processing to convert the received data signal into a pulse signal and a control unit which detects information included in the data signal based on a time interval between starting points of pulse periods which are in a row in the pulse signal.

10 Claims, 7 Drawing Sheets

ELECTRONIC APPARATUS AND METHOD FOR DETECTING INFORMATION USING THE SAME

PRIORITY

This application claims priority from Korean Patent Application No. 10-2012-0001723, filed on Jan. 5, 2012, in the Korean Intellectual Property Office, the disclosure of which is incorporated herein by reference in its entirety.

BACKGROUND

1. Field

Methods and apparatuses consistent with the exemplary embodiments relate to an electronic apparatus and a method for detecting information using the same, and more particularly, to an electronic apparatus which detects a data signal received from a remote control device and a method thereof.

2. Description of the Related Art

Nowadays, remote control devices (for example, remote controllers) which can control a variety of electronic apparatuses from a remote distance have become indispensable instruments. Recently, thanks to the development of electronic technologies, electronic apparatuses and remote control devices can transmit and receive data not only via one-way communications but also via two-way communication.

Meanwhile, if a signal transmitted from a remote control device to an electronic apparatus is affected by noise, the electronic apparatus cannot perform an operation which a user wishes.

In particular, if the electronic apparatus and the remote control device perform two-way communication with each other, a signal transmitted from the electronic apparatus to the remote control device can interfere with another signal transmitted from the remote control device to the electronic apparatus.

Therefore, there is a need to find out a solution which addresses interference which can occur between an electronic apparatus and a remote control device when they perform two-way communication with each other.

SUMMARY

Exemplary embodiments address at least the above problems and/or disadvantages and other disadvantages not described above. Also, the exemplary embodiments provide an electronic apparatus which prevents a signal transmitted from an electronic apparatus to a remote control device from interfering with another signal transmitted from the remote control device to the electronic device, and a method for detecting information thereof.

According to an exemplary embodiment, there is provided an electronic apparatus performing two-way communication with a remote control device. The electronic apparatus includes a receiving unit which receives a data signal from the remote control device, a signal processing unit which performs signal processing to convert the received data signal into a pulse signal, and a control unit which detects information included in the data signal based on a time interval between starting points of pulse periods which are in a row in the pulse signal.

In this case, the control unit may detect the information included in the data signal based on a time interval between falling edges or rising edges of the pulse periods.

Meanwhile, the signal processing unit may include an automatic gain control unit which adjusts amplitude of the data signal to be within a predetermined range of amplitude, a filter unit which filters the adjusted data signal and a pulse shaping unit which converts the filtered data signal into a pulse signal.

In this case, the electronic apparatus according to an exemplary embodiment may further include a transmitting unit which transmits a reply signal in response to the data signal to the remote control device, wherein the control unit may compensate for a change in duty of the pulse signal caused by interference from the reply signal.

Herein, the reply signal may have a larger amplitude than the data signal, and the change in duty of the pulse signal may be caused by a difference in amplitude between the reply signal and the data signal.

The electronic apparatus according to an exemplary embodiment may further include a storage unit which maps code information in accordance to a time interval between the falling edges of the pulse periods and storing the code information, wherein the control unit may detect from the storage unit the code information corresponding to the time interval between the starting points of the pulse periods which are in a row in the pulse signal.

Meanwhile, a method for detecting information of an electronic apparatus which performs two-way communication with a remote control device includes receiving a data signal from the remote control device, performing signal processing to convert the received data signal into a pulse signal, and detecting information included in the data signal based on a time interval between starting points of pulse periods of the pulse signal.

In this case, the detecting information may be detecting information included in the data signal based on a time interval between falling edges or rising edges of the pulse periods.

The converting the received data signal into the pulse signal may include adjusting the amplitude of the data signal to be within a predetermined range of amplitude, filtering the adjusted data signal and converting the filtered data signal into the pulse signal.

Herein, the method according to an exemplary embodiment may further include transmitting a reply signal in response to the data signal to the remote control device, wherein the detecting the information included in the data signal may be compensating for a change in duty of the pulse signal caused by interference from the reply signal.

In this case, the amplitude of the reply signal may be larger than the amplitude of the data signal, and the change in duty of the pulse signal may be caused by a difference in the amplitude between the reply signal and the data signal.

Meanwhile, the detecting the information included in the data signal may be detecting code information corresponding to the time interval between the starting points of the pulse periods of the pulse signal based on pre-stored code information in accordance with a time interval between starting points of the pulse periods.

According to the above-described various exemplary embodiments, a pulse signal may be generated based on a data signal received from a remote control device, and information included in the data signal may be detected based on a time interval between starting points of consecutive pulse sections. Accordingly, it is possible to detect information, which is included in the data signal regardless of a change in duty of a pulse signal caused by interference from a signal transmitted from the electronic apparatus.

BRIEF DESCRIPTION OF THE DRAWINGS

The above and/or other aspects will be more apparent by describing in detail exemplary embodiments, with reference to the accompanying drawings, in which.

DETAILED DESCRIPTION OF THE EXEMPLARY EMBODIMENTS

Hereinafter, exemplary embodiments will be described in larger detail with reference to the accompanying drawings.

Figure 1:
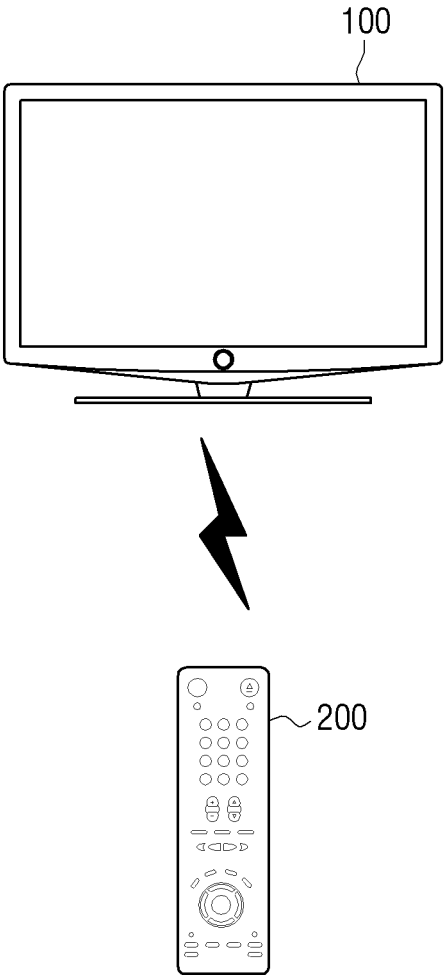
FIG. 1 is a view of a system including an electronic apparatus and a remote control device according to an exemplary embodiment.

FIG. 1 is a view illustrating a system comprising an electronic apparatus and a remote control device according to an exemplary embodiment. Referring to FIG. 1, a system includes an electronic apparatus 100 and a remote control device 200.

The electronic apparatus 100 performs two-way communication with the remote control device 200 and performs an operation corresponding to a data signal which is received from the remote control device 200. Specifically, the electronic apparatus 100 receives a data signal from the remote control device 200 via two-way, non-oriented (or anti-oriented) Radio Frequency communication, and each of the electronic apparatus and the remote control device may operate as a master and a slave of each other.

For instance, if a data signal for requesting a transmission of a key code value stored in the electronic apparatus 100 is received from the remote control device 200, the electronic apparatus 100 may transmit the pre-stored key code value to the remote control device 200. The remote control device 200 may control operations of the electronic apparatus 100 by matching the received key code value with a plurality of buttons installed in the remote control device 200.

Meanwhile, FIG. 1 illustrates a case where the electronic apparatus 100 is realized as a TV, but this is merely exemplary. In other words, any type of electronic apparatuses including, but not limited to, a Set-up Box, a DVD player, a portable terminal device, a desktop and a laptop PC, which operate according to a data signal received from the remote control device 200, may be the electronic apparatus 100 according to an exemplary embodiment. The remote control device 200 may be a remote controller which controls the electronic apparatus 100.

Figure 2:
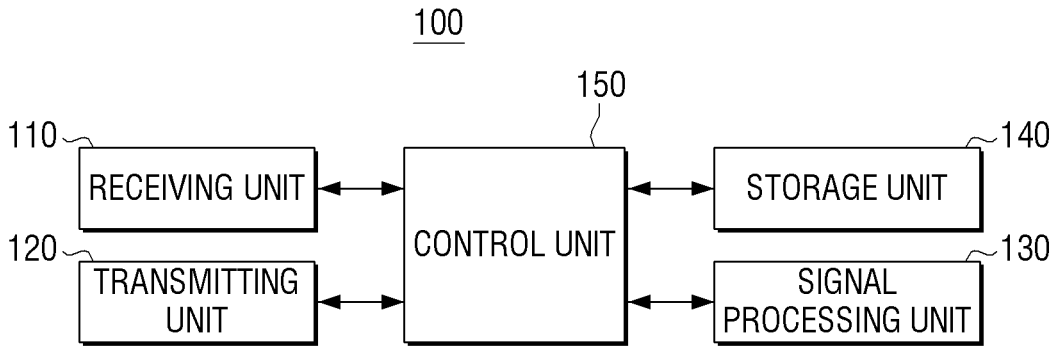
FIG. 2 is a block diagram to explain a configuration of an electronic apparatus according to an exemplary embodiment.

FIG. 2 is a block diagram which illustrates a configuration of an electronic apparatus 100 according to an exemplary embodiment. Referring to FIG. 2, an electronic apparatus 100 includes a receiving unit 110, a transmitting unit 120, a signal processing unit 130, a storage unit 140 and a control unit 150. These various units may be implemented as particular hardware or as software running on a general purpose computer processor such as a CPU or the like.

The receiving unit 110 receives a data signal from the remote control device 200. Herein, the data signal refers to a signal to control operations of the electronic apparatus 100. In other words, the data signal may include a key code signal matched with each of buttons installed to the remote control device 200 and a signal requesting a transmission of a specific data stored in the electronic apparatus 100.

The transmitting unit 120 transmits a reply signal corresponding to the data signal to the remote control device 200. As the electronic apparatus 100 performs two-way communication with the remote control device 200, the transmitting unit 120 may transmit a reply signal corresponding to a data signal when the data signal is received from the remote control device 200. For instance, if the signal requesting a transmission of a specific data is received from the remote control device 200, the transmitting unit 120 may transmit an ACK signal and a specific data to the remote control device 200.

As described above, the electronic apparatus 100 performs two-way communication with the remote control device 200 so that the receiving unit 110 and the transmitting unit 120 may be embedded with an RF communication module, a Bluetooth communication module, a ZigBee communication module and other communication modules.

Figure 3:
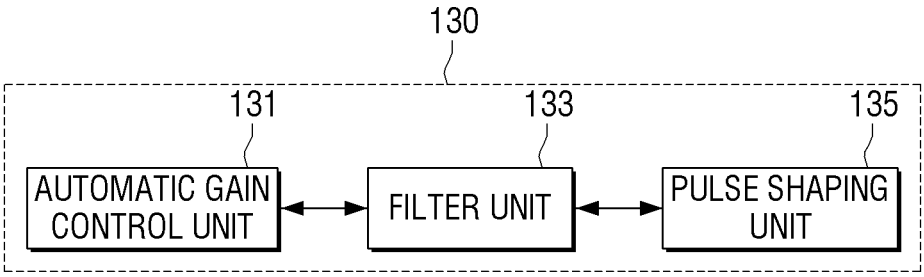
FIG. 3 is a block diagram to explain a configuration of a receiving unit according to an exemplary embodiment.

The signal processing unit 130 converts the received data signal into a pulse signal by performing signal processing. The signal processing unit 130 may include an automatic gain control unit 131, a filter unit 133 and a pulse shaping unit 135 as illustrated in FIG. 3.

The automatic gain control unit 131 adjusts the amplitude of a data signal to be within a predetermined range of amplitude. Specifically, the automatic gain control unit 131 may include an Auto Gain Control (AGC) which increases the amplitude of a data signal, if the amplitude is narrow, or decreases the same, if the amplitude is great, in order to adjust the amplitude of the data signal to be within a predetermined range of amplitude.

The filter unit 133 filters the adjusted data signal. Specifically, the filter unit 133 may help only a signal having a specific frequency band among amplitude-adjusted data signals to pass using a band-pass filter.

The pulse shaping unit 135 converts the filtered data signal into a pulse signal. Specifically, the pulse shaping unit 135 may convert the data signal into a pulse signal having a plurality of pulse periods by performing an integral operation on the filtered data signal. If necessary, the pulse shaping unit 135 may further perform an operation of a hysteresis comparator.

The control unit 150 controls overall operations of the electronic apparatus 100. In particular, the control unit 150 controls each of the configurations of the electronic apparatus 100 to perform an operation corresponding to a data signal received from the remote control device 200.

For instance, if a data signal for turning off the electronic apparatus 100 is received from the remote control device 200, the control unit 150 may cut the power supply for each of configurations of the electronic apparatus 100. In another example, if a data signal for requesting a transmission of a key code value stored in the electronic apparatus 100 is received from the remote control device 200, the control unit 150 may control the transmitting unit to transmit the key code value of the electronic apparatus 100 to the remote control device 200.

The control unit 150 detects information included in the data signal which is received from the remote control device 200. In other words, the control unit 150 may detect a user command input in the remote control device 200 through a data signal received from the remote control device 200.

Specifically, the control unit 150 may detect information included in the data signal based on a time interval between starting points of pulse periods which are consecutive in a pulse signal converted in the signal processing unit 120. Herein, the control unit 150 may detect information included in a data signal based on a time interval among falling edges or rising edges of the pulse periods.

As described above, the control unit 150 may detect information included in a data signal based on a time interval between starting points of pulse periods since the electronic apparatus 100 performs two-way communication with the remote control device 200. Further details will be provided with reference to FIGS. 4 to 6.

If the receiving unit 110 receives a data signal, the control unit 150 controls the transmitting unit 120 to transmit a reply signal corresponding to the received data signal to the remote control device 200. Herein, the reply signal has a larger amplitude than the data signal so that the reply signal may interfere with the data signal.

Figure 4:
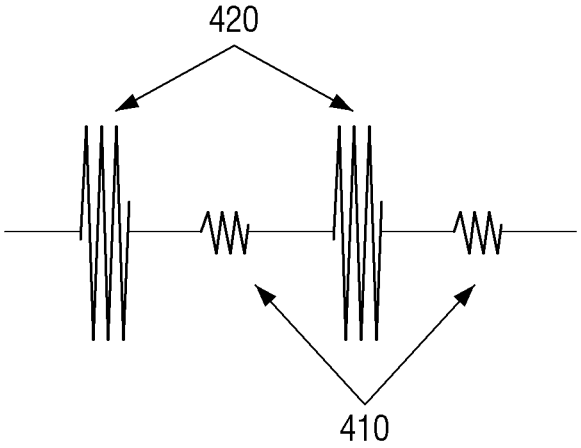
FIG. 4 is a view to explain a signal received in a receiving unit according to an exemplary embodiment.

If the receiving unit 110 and the transmitting unit 120 are positioned close to each other, the reply signal transmitted from the transmitting unit 120 may flow into the receiving unit 110. In other words, as illustrated in FIG. 4, the reply signal having a larger range of amplitude than the data signal may flow into the receiving unit 110. The reply signal flowing into the receiving unit 110 may interfere with the data signal received from the remote control device 200 when passing through the signal processing unit 130.

Specifically, by adjusting a gain, the automatic gain control unit 131 increases or decreases the amplitude of the signal received from the receiving unit 110 so that the amplitude may be within a predetermined range of amplitude. However, as illustrated in FIG. 4, a data signal 410 having narrow amplitude is input to the automatic gain control unit 131 following a reply signal 420 having a large amplitude, the amplitude of the data signal cannot be adjusted to be within a predetermined range. In other words, the reply signal having relatively larger amplitude interferes with the data signal having relatively narrower amplitude.

Specifically, during a time when the reply signal is being input, the automatic gain control unit 131 decreases a level of amplitude of the reply signal to be within a predetermined range of amplitude by applying a small gain (or a level of amplitude).

Thereafter, the automatic gain control unit 131 should amplify a data signal received after the reply signal to be within a predetermined range of amplitude. However, the automatic gain control unit 131 cannot increase the gain, which has been reduced during a time when the reply signal is being input, to be a gain, which is necessary to amplify the amplitude of the data signal during a time when the data signal is being input. Thus, the amplitude of the data signal becomes narrower than a predetermined range of amplitude.

In other words, the automatic gain control unit 131 is not able to increase the gain, which has been reduced during a time when the reply signal is being input, to be a gain, which is to amplify the amplitude of the data signal during a time when the data signal is being input. Therefore, the amplitude of the data signal becomes narrower than a predetermined range of amplitude.

Accordingly, the pulse shaping unit 135 performs an integral operation to convert the data signal having amplitude narrower than a predetermined range of amplitude into a pulse signal so that the converted pulse signal may have a narrower width of pulse periods than the original data signal. Hereinafter, further details will be provided with reference to FIGS. 5A and 5B.

Figure 5A:
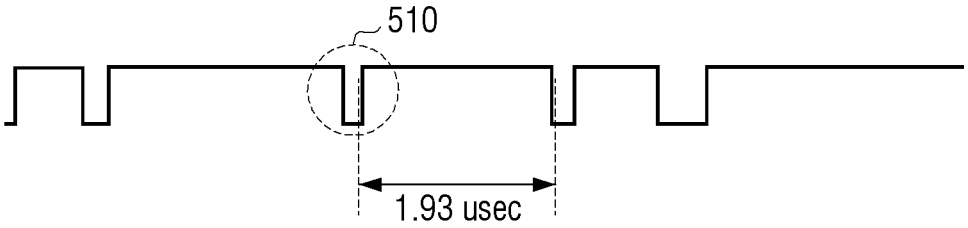
FIGS. 5A and 5B are views to explain pulses generated by data signals according to whether there is interference from a reply signal according to an exemplary embodiment.
Figure 5B:
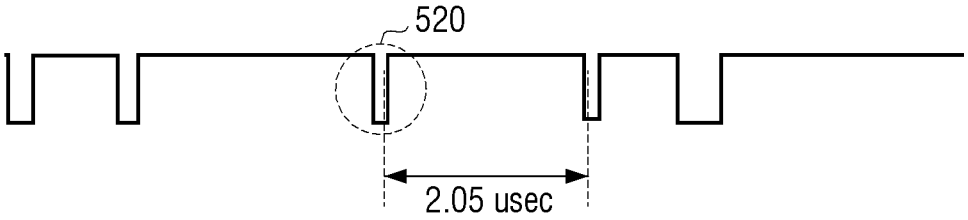

FIG. 5A is a pulse signal generated by a data signal which is not interfered by a reply signal, and FIG. 5B is another pulse signal generated by a data signal which is interfered by the reply signal.

As illustrated in FIGS. 5A and 5B, the pulse period (inside the dotted-line circle 520 in FIG. 5B) generated by the data signal which is interfered by the reply signal has a narrower width than the pulse period (inside the dotted-line circle 510 in FIG. 5A) generated by the data signal which is not interfered by the reply signal. Accordingly, a time interval between a rising edge of a first pulse period and a falling edge of the next pulse period increases from 1.93 μs to 2.5 μs.

As described above, since the reply signal has a larger amplitude than the data signal, a duty of the pulse signal is changed due to the difference in amplitude between the reply signal and the data signal.

Accordingly, the control unit 150 detects information included in the data signal based on a time interval between starting points of consecutive pulse periods. Meanwhile, when the data signal is received from the remote control device 200, the receiving unit 110 may notify the control unit 150 of the receipt. Accordingly, the control unit 160 may filter a pulse signal corresponding to the reply signal from pulse signals, which are generated based on the data signal and the reply signal, and detect information using a pulse signal which is converted based on the data signal.

Figure 6A:
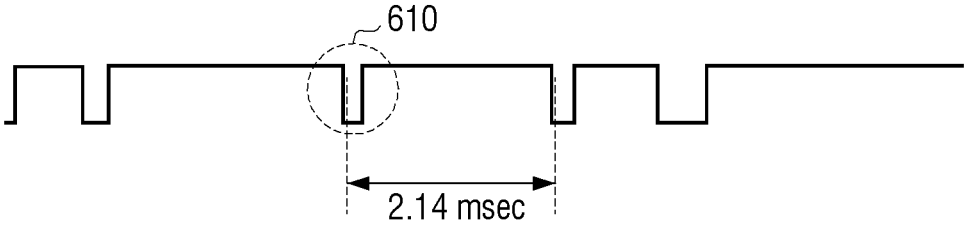
FIGS. 6A and 6B are views to explain a method for detecting information generated by a data signal according to whether there is interference from a reply signal according to an exemplary embodiment.
Figure 6B:
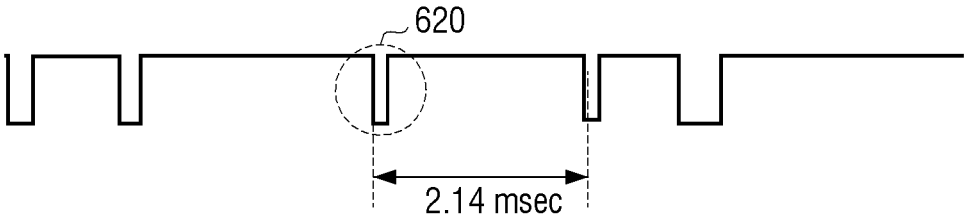

FIG. 6A is a view which illustrates a method for detecting information from a pulse generated by a data signal which is not interfered by a reply signal, and FIG. 6B is a view which illustrates a method for detecting information from a pulse generated by another data signal which is interfered by a reply signal.

As illustrated FIGS. 6A and 6B, in the response to the interference from the reply signal, the width of the pulse period is reduced (see the pulses illustrated inside of the dotted-line circle 610 in FIG. 6A and the dotted-line circle 620 in FIG. 6B), but the time interval of the falling edges of the pulse periods is 2.14 ms in both cases.

Accordingly, since the control unit 150 detects a time interval of starting points of pulse periods and detects code information corresponding to the time interval, the control unit 150 may compensate for a change in duty caused by interference from a reply signal.

Meanwhile, FIGS. 6A and 6B illustrate cases that starting points of pulse periods are falling edges, for convenience sake. However, starting points of pulse periods may be rising edges. In this case, if a time interval between rising edges of pulse periods is detected, information corresponding to the time interval may be detected.

The storage unit 140 is a recording medium storing a variety of programs necessary to operate the electronic apparatus 100, and may be realized as memory, Hard Disk Drive (HDD) and the like.

In particular, the storage unit 140 maps and stores code information corresponding to a time interval between starting points of pulse periods. Specifically, the storage unit 140 may store a mapping table where each of code information corresponding to a time interval between starting points of pulse periods is mapped. For instance, the storage unit 140 may include a mapping table indicating that, if a time interval between falling edges of pulse periods, corresponding code information is 0X91, and, if the time interval is 2.24 ms, corresponding code information is OXA1.

Accordingly, the control unit 150 may detect code information corresponding to a time interval between starting points of pulse periods which are in a row in a pulse signal. In addition, the control unit 150 may detect a user command transmitted from the remote control device 200 based on the detected code information and perform a corresponding operation.

Figure 7:
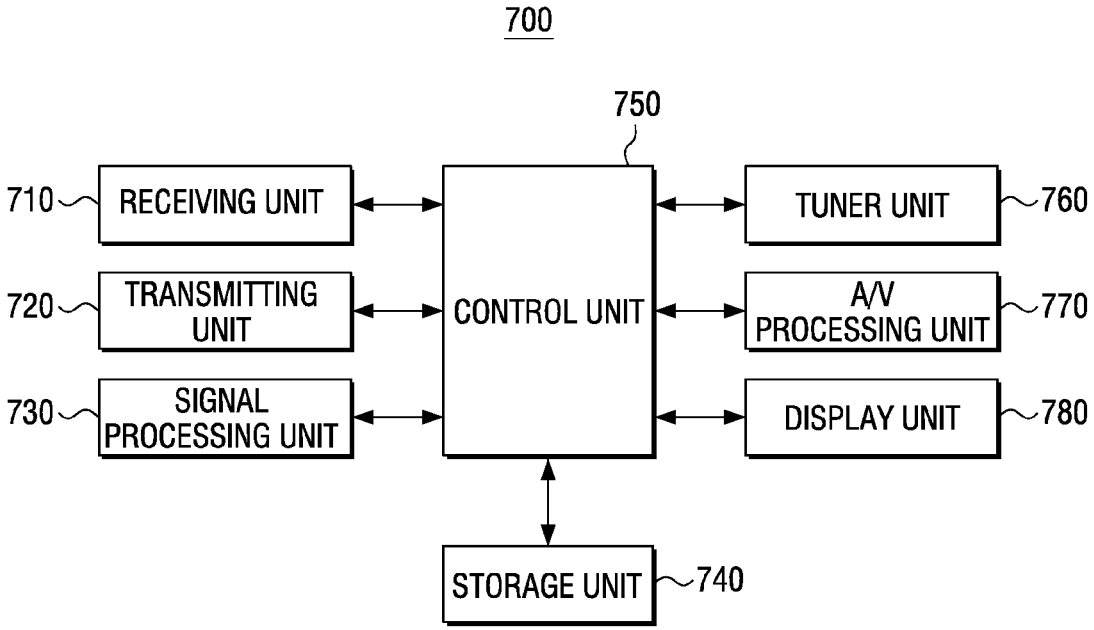
FIG. 7 is a block diagram to explain a configuration of an electronic apparatus according to an exemplary embodiment.

FIG. 7 is a view to explain a configuration of an electric apparatus according to an exemplary embodiment. Referring to FIG. 7, the electric apparatus 700 includes a receiving unit 710, a transmitting unit 720, a signal processing unit 730, a storage unit 740, a control unit 750, a tuner unit 760, an A/V processing unit 770 and a display unit 780. In particular, FIG. 7 is a view to illustrate a case where the electric apparatus is realized as a TV according to an exemplary embodiment, so further details overlapped with FIGS. 1 to 6 will not be provided.

The tuner unit 760 receives a broadcast content. Specifically, the tuner unit 760 may include a tuner (not shown), a demodulator (not shown), an equalizer (not shown) and the like in order to receive a broadcast content from a broadcasting station.

The above-described exemplary embodiments illustrate cases where a broadcast content is received from a broadcasting station. In other words, the electronic apparatus 700 may have a network interface card (not shown) to receive a broadcast content from a web server transmitting content files using the Internet. In addition, the electronic apparatus 700 may receive a content from a variety of recording medium reproducing devices, which are embedded with or connected to the electronic apparatus 700. The recording medium reproducing device refers to a device which reproduces a content stored in various types of recording media such as, but not limited to, a CD, a DVD, a hard disk, a memory card, a USB memory and the like. In this case, the electronic apparatus 700 may have an interface unit (not shown) connected to a recording medium reproducing device (not shown).

The A/V processing unit 770 performs signal processing on the received content. Specifically, the A/V processing unit 770 may include a demultiplexer (not shown) to separate video and audio data from the received content, a video/audio decoder (not shown) decoding video and audio data, a frame rate conversion unit (not shown) converting frame rate of video data with reference to an output rate of the display unit 780, a scaler performing up or down scaling on video data according to a screen size of the display unit 780. In this manner, the A/V processing unit 770 may perform signal processing to convert video and audio data included in the received content into an outputable data.

The display unit 780 may output the received broadcast content. The display may include a display panel (Not Shown), which may be realized as a Liquid Crystal Display (LCD), an Organic Light Emitting Display (OLED), a Plasma Display Panel (PDP) and the like, and a panel driving unit (not shown) driving the display panel.

The control unit 750 may control each of configurations of the electronic apparatus 700 to perform an operation corresponding to a received data signal.

The control unit 750 controls the A/V processing unit 770 to convert a data signal received from the remote control device 200 into a pulse signal. In addition, the control unit detects information included in the data signal based on a time interval of starting points of pulse periods which are in a row in the converted pulse signal. Specifically, the control unit 750 detects code information corresponding to a time interval between starting points of consecutive pulse periods using a mapping table stored in the storage unit 740, and performs an operation corresponding to the code information. For instance, if the detected code information is OXA1, the control unit 750 may control the transmitting unit 720 to read a key code value from the storage unit 740 to control the electronic apparatus 700 and transmit the key code value to the remote control device 200.

Meanwhile, the remote control device 200 may control operations of the electronic apparatus 700 by matching key code values with various buttons embedded in the remote control device 200. For instance, if a user selects a channel change command programmed in the remote control device 200, the remote control device 200 transmits a data signal having a key code value corresponding to the channel change command to the electronic apparatus 700. In this case, the control unit 750 may detect information about the channel change command from the received data signal, and control the tuner unit 760 to select the corresponding channel and the display unit 780 to output a broadcast content received from the selected channel.

Figure 8:
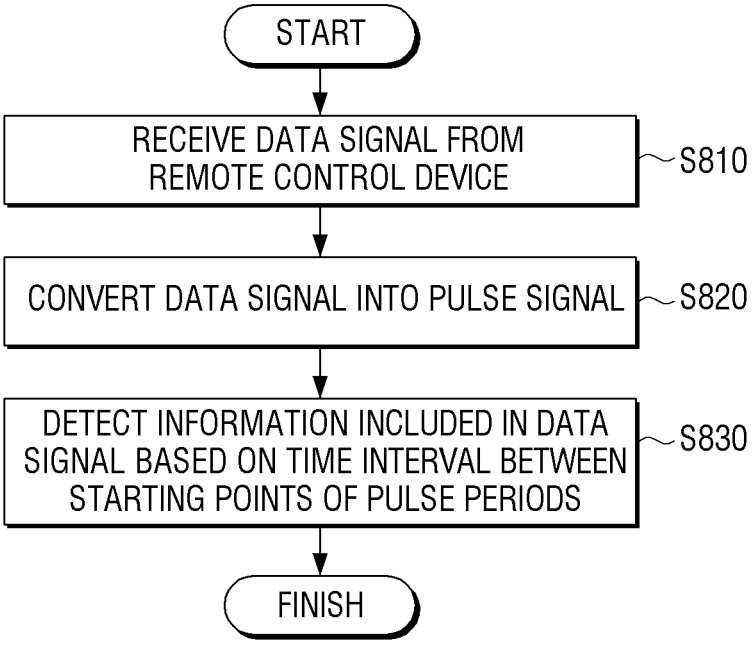
FIG. 8 is a flowchart to explain a method for detecting information from a data signal received from a remote control device of an electronic apparatus according to an exemplary embodiment.

FIG. 8 is a flow chart to illustrate a method of the electronic apparatus for detecting information from a data signal received from a remote control device according to an exemplary embodiment. In particular, the electronic apparatus may perform two-way communication with the remote control device.

A data signal is received from the remote control device (operation S810).

Then, signal processing is performed to convert the received data signal into a pulse signal (operation S820).

Specifically, the amplitude of the data signal is adjusted to be within a predetermined range of amplitude, the adjusted data signal is filtered, and the filtered data signal is converted into a pulse signal.

More specifically, large or narrow amplitude of an analog data signal is adjusted to be narrower or larger, respectively, using an Auto Gain Control (AGC) so that the amplitude of the data signal may be within a predetermined range of amplitude.

In addition, information included in the data signal is detected based on a time interval between starting points of pulse periods which are in a row in the pulse signal (operation S830). In this case, the information included in the data signal may be detected based on a time interval between falling edges or rising edges of pulse periods.

Meanwhile, according to an exemplary embodiment, a step of transmitting a reply signal in response to a data signal to the remote control device may be further included. In this case, a change in duty of the pulse signal caused by interference from the reply signal may be compensated in the step of operation S830.

Meanwhile, according to an exemplary embodiment, a reply signal in response to a data signal is transmitted since the electronic apparatus performs two-way communication with the remote control device, and the reply signal may have a larger amplitude than the data signal.

In this case, a duty of the pulse signal may be changed by interference from the reply signal, and more specifically, a duty of the pulse signal may be changed by a difference in amplitude between the reply signal and the data signal.

Thus, in the step of operation 5830, code information corresponding to a time interval between starting points of pulse periods which are in a row in the pulse signal may be detected based on pre-stored code information corresponding to a time interval between starting points of pulse periods.

Further details for the above will not be provided since they were described before.

Meanwhile, programs to employ methods according to the above-described exemplary embodiments may be stored in various kinds of recording media to be used.

Specifically, codes to employ the above-described methods may be stored in various kinds of terminal readable recording media, such as Random Access Memory (RAM), flash memory, Read Only Memory (ROM), Erasable Programmable ROM (EPROM), Electronically Erasable and Programmable ROM (EEPROM), resister, hard disk, removable disk, memory card, USB memory and CD-ROM.

The foregoing exemplary embodiments and advantages are merely exemplary and are not to be construed as limiting. The present teaching can be readily applied to other types of apparatuses. Also, the description of the exemplary embodiments are intended to be illustrative, and not to limit the scope of the claims, and many alternatives, modifications, and variations will be apparent to those skilled in the art.

What is claimed is:

1. An electronic apparatus performing two-way communication with a remote control device, the apparatus comprising:

a receiving unit which receives a data signal from the remote control device;

a signal processing unit which performs signal processing to convert the received data signal into a pulse signal;

a storage unit which maps code information corresponding to a time interval between falling edges of the pulse periods and stores the code information; and a control unit which detects information included in the received data signal based on a time interval between starting points of pulse periods which are in a row in the pulse signal, wherein the control unit detects the code information corresponding to the time interval between the starting points of the pulse periods which are in a row in the pulse signal.

2. The apparatus as claimed in claim 1, wherein the control unit detects the information included in the received data signal based on a time interval between falling edges or rising edges of the pulse periods.

3. The apparatus as claimed in claim 1, wherein the signal processing unit comprises:

an automatic gain control unit which adjusts an amplitude of the received data signal to be within a predetermined amplitude range;

a filter unit which filters the adjusted data signal; and a pulse shaping unit which converts the filtered data signal into the pulse signal.

4. The apparatus as claimed in claim 3, further comprising a transmitting unit which transmits a reply signal to the data signal to the remote control device in response to the received data signal;

wherein the control unit compensates for a change in duty of the pulse signal caused by interference from the reply signal.

5. The apparatus as claimed in claim 4, wherein the reply signal has a larger amplitude than an amplitude of the received data signal, and the change in duty of the pulse signal is caused by a difference in amplitude between the reply signal and the received data signal.

6. A method for detecting information of an electronic apparatus which performs two-way communication with a remote control device; the method comprising, receiving a data signal from the remote control device;

performing signal processing to convert the received data signal into a pulse signal; and detecting information included in the received data signal based on a time interval between starting points of pulse periods of the pulse signal, wherein the detecting information is detecting code information corresponding to the time interval between the starting points of the pulse periods of the pulse signal based on pre-stored code information in accordance with a time interval between starting points of the pulse periods.

7. The method as claimed in claim 6, wherein the detecting information is detecting information included in the received data signal based on a time interval between falling edges or rising edges of the pulse periods.

8. The method as claimed in claim 7, wherein converting into the pulse signal comprises:

adjusting an amplitude of the received data signal to be within a predetermined amplitude range;

filtering the adjusted data signal; and converting the filtered data signal into the pulse signal.

9. The method as claimed in claim 8, further comprising:

transmitting a reply signal to the remote control device in response to the received data signal; and compensating for a change in duty of the pulse signal caused by interference from of the reply signal.

10. The method as claimed in claim 9, wherein the amplitude of the reply signal has a larger amplitude than an amplitude of the received data signal, and the change in duty of the pulse signal is caused by a difference in amplitude between the reply signal and the received data signal.

* * * * *